United States Patent [19]

Peslier

[11] 4,376,910

[45] Mar. 15, 1983

[54] POWER SUPPLY AND CONTROL DEVICE FOR THE PROPER OPERATION OF A RAILWAY TRAFFIC LIGHT

[75] Inventor: Jacques F. Peslier, Manou, France

[73] Assignee: Jeumont-Schneider, Puteaux, France

[21] Appl. No.: 247,538

[22] PCT Filed: Jul. 4, 1980

[86] PCT No.: PCT/FR80/00110

§ 371 Date: Mar. 16, 1981

§ 102(e) Date: Mar. 16, 1981

[87] PCT Pub. No.: WO81/00238

PCT Pub. Date: Feb. 5, 1981

[30] Foreign Application Priority Data

Jul. 16, 1979 [FR] France ..... 79 18323

[51] Int. Cl.[3] ..... H05B 37/03

[52] U.S. Cl. ..... 315/134; 246/28 G; 315/136; 315/239; 340/310 A; 340/641

[58] Field of Search ..... 315/129, 130, 134, 135, 315/136, 227 R, 239, 256; 340/47, 310 A, 310 R, 332, 538, 641, 643; 246/1 C, 28 F, 28 G, 473 R

[56] References Cited

U.S. PATENT DOCUMENTS

| | | | |
|---|---|---|---|
| 2,197,700 | 4/1940 | MacGregor | 340/641 |
| 2,860,263 | 11/1958 | Sparrow | 340/641 X |
| 2,905,861 | 9/1959 | Ganzenhuber | 315/136 |
| 3,026,448 | 3/1962 | Brown | 315/136 X |

FOREIGN PATENT DOCUMENTS

| | | | |
|---|---|---|---|
| 1506451 | 4/1978 | United Kingdom | 315/130 |

*Primary Examiner*—Eugene R. La Roche

*Attorney, Agent, or Firm*—Schwartz, Jeffery, Schwaab, Mack, Blumenthal & Koch

[57] ABSTRACT

A periodic current generator is connected with a long power supply line through a first transformer. The lamp of the traffic light is connected to the long line through a second transformer. First and second safety capacitors with four terminals each are respectively arranged in series on the long line with the first and second transformers. A DC current is generated by a detector when the lamp is operating. The detector is connected to one of the capacitors and the DC current passes through the long line to the second capacitor across which the coil of a relay is connected. The relay is actuated by the DC current and sends information concerning the status of the lamp to a central control station.

9 Claims, 2 Drawing Figures

POWER SUPPLY AND CONTROL DEVICE FOR THE PROPER OPERATION OF A RAILWAY TRAFFIC LIGHT

BACKGROUND OF THE INVENTION

Field of the Invention

The present invention relates to a power supply and control device for the proper operation of a railway traffic light suitable for the detection of defects in an electrical line.

It is presently known that to insure the safety of railway traffic, it is indispensably necessary to monitor the proper operation of traffic lights. For this purpose, it is known to use a relatively complex supply and control device in series with the electrical supply line of the lights, which is insulated from the ground. The supply and control device comprises a relay which functions only when a given nominal current is circulating in the line. However, this assembly is expensive, and the length of the supply lines with which it can be used is limited.

SUMMARY OF THE INVENTION

It is the object of the present invention to eliminate these disadvantages. The present invention concerns a power supply and control device for the proper operation of a railway signal light and comprises a periodic current generator connected to a long electrical power supply line through a first isolation transformer. The electric lamp of the traffic light is connected with the long line through a second isolation transformer.

According to the invention, first and second safety capacitors with four terminals each are connected in series through a first pair of their terminals with the long line, the secondary coil of the first transformer, and the primary coil of the second transformer. The second pair of terminals of the first capacitor are connected with the coil of a relay supplied with continuous current. The second terminals of the second capacitor are connected to terminals of the outlet of a detector which detects the operation of the lamp and generates a direct current when the lamp is operating.

BRIEF DESCRIPTION OF THE DRAWINGS

The present invention shall become more apparent and further objects, characteristics and advantages of the invention will appear more clearly from the detailed description of the preferred embodiment of the invention set forth hereinafter, reference being had to the accompanying drawings in which.

DESCRIPTION OF THE PREFERRED EMBODIMENT

Figure 1:
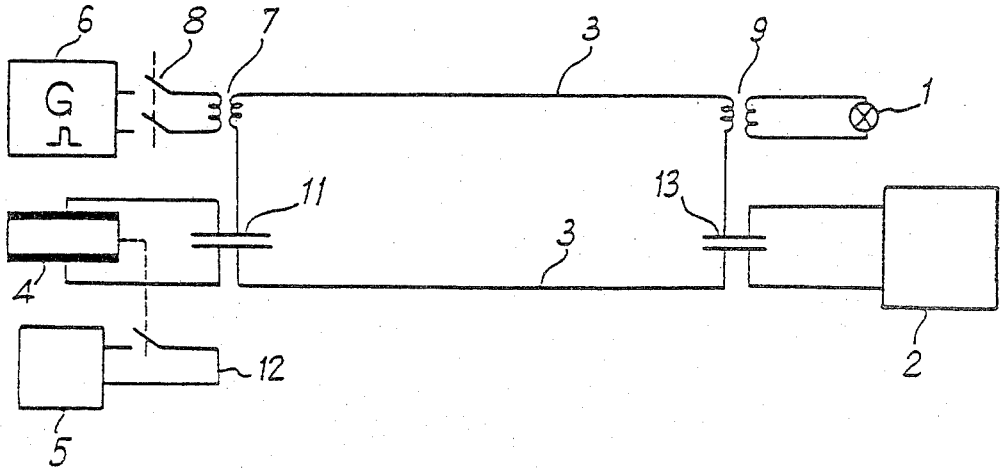
FIG. 1 represents schematically a supply and control device according to the invention and FIG. 2 shows in detail a preferred mode of embodiment of the detector of operation according to the invention.

Referring now to FIG. 1, the detection of the state of the lamp 1 of the signal light is effected locally at the light by the detector 2. The information obtained is transmitted through the line 3 of the power supply of the lamp 1 to the coil of a relay 4, which transmits the information upstream to a central control station 5. This detection is not disturbed in any way by this fact, by means of the idle currents of the transformers increased by the capacitive current of the cable. More precisely, a generator 6 of periodic current is connected with the long line 3 through a first isolation transformer 7 and a switch 8 to control the light. The generator 6 may consist of a generator of sinusoidal alternating current or sawtooth current or a continuous current chopper, delivering for example a voltage of 127 Volts at a frequency of 400 Hertz. The lamp 1 is connected to the other end of the line 3, through a second isolation transformer. A four terminal safety capacitor 11 is placed in series with the secondary coil of the transformer 7, in the long line 3. Capacitor 11 is characterized in that it is equipped on each of its plates with two terminals electrically connected with each other by the plate itself.

A first pair of terminals of capacitor 11 is used for the series connection in the line 3. The second pair of terminals of the capacitor 11 is connected with the coil of a relay 4. Relay 4 operates in response to a continuous current and is insensitive to periodic currents. The relay 4 controls the opening or closing of a line 12, providing a display of the condition of the lamp 1 in a central control station 5.

A second safety capacitor 13 with four terminals is placed in series through a first pair of terminals in the long line 3 with the primary coil of the isolation transformer 9. The second pair of terminals of the capacitor 13 is connected with the outlet terminals of the operation detector 2 of the lamp 1, with the detector generating a continuous current.

By virtue of this arrangement, the circuit connected to the outlet of detector 2 conducts the continuous current generated by the detector 2 through the plates of capacitors 11 and 13 the secondary of the transformer 7 and the primary of the transformer 9.

During operation, when the switch 8 is closed, a periodic current circulates in the long line 3 to supply the lamp 1. The detector 2, if the lamp is lit, generates a continuous current which circulates in the long line 3 to supply the coil of the relay 4. The information that the lamp is operating properly then is transmitted to the central station 5 through the line 12. The information that the lamp 1 has been extinguished, for example by the breakage of the filament or an unintentional grounding of the long line 3, is immediately transmitted to the central station 5.

The detector 2 of the operating state of the lamp 1 may be embodied in several ways.

Figure 2:
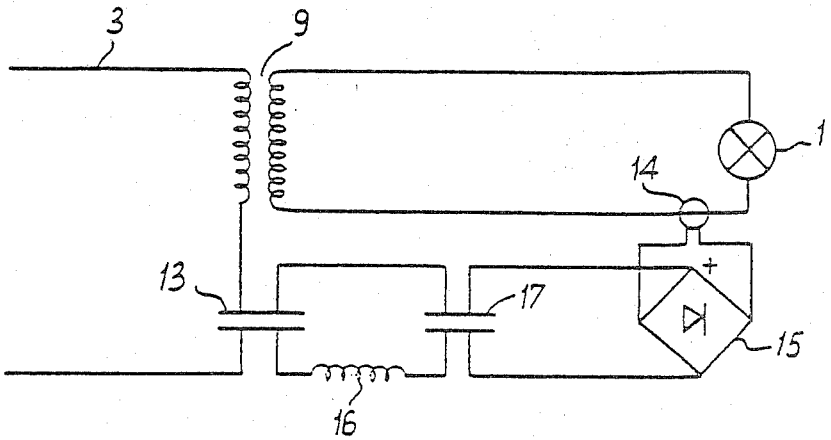

A photoelectric cell placed behind the lamp with respect to the lens or above the lamp may be used as the detector. However, in order to eliminate the sensitivity of said cell to solar light focused by the lens of the signal light, it is preferable that the cell be sensitive only to radiation emitted in the infrared range. This insures that accurate information concerning the proper operation of the lamp is transmitted to the central station. Similarly, a thermocouple placed in the immediate vicinity of the filament of the lamp, inside or outside the glass bulb of the lamp, may also be used as the detector of operation. However, the preferred embodiment of a detector 2 of operation is shown in FIG. 2, wherein the same reference symbols designate elements common with FIG. 1. Detector 2 comprises a current transformer 14 with its primary coil placed in series with the lamp to be controlled and the secondary coil of the second isolation transformed 9. The secondary coil of transformer 14 is connected with the terminals of a rectifier 15, so that a direct current is generated when a periodic current is circulating in the lamp. The direct current outlet terminals of the rectifier 15 are connected with the second pair of terminals of the safety capacitor 13 through a filter comprising at least one safety inductance 16 placed in series with the circuit so that the periodic current circulating in the long line 3 is prevented from reaching the diodes of the rectifier 15. In order to render this filter more efficient, a capacitor 17 may be placed between the outlet terminals of the rectifier 15. The condenser 17 preferably consists of a four terminal safety capacitor in order to detect a possible failure of this component. The combination of the inductance 16 and the capacitor 17 yields a voltage divider of the periodic voltage, so that the periodic voltage applied to the diodes of the rectifier 15 is less than the minimum conduction voltage of said diodes.

The rectifier 15 may comprise two Zener diodes in order to insure the regulation of the continuous current applied to the second pair of terminals of the safety capacitor 13, regardless of the intensity of the lamp to be controlled.

Even though a single mode of embodiment of the invention has been described, it is obvious that many modifications may be made by those skilled in the art without departing from the scope and the spirit of the invention as set forth in the appended claims. In particular, when the lamp 1 operates in a flashing mode, the capacitor 17 may consist advantageously of a high strength chemical capacitor to delay the relay 4 during the voltage drop, in order to keep said relay from transmitting the information that the lamp is not operating, to the central station 5 in each period.

Furthermore, by the addition of a device to verify the agreement between the state of the switch 8 for the control of the light and the condition of the relay 4, it is possible to detect a possible unintended lighting of the lamp, for example due to a voltage induced in the long line 3, even though the switch 8 is not closed.

I claim:

1. A system for energizing and monitoring the operation of a railway traffic light, comprising:

an alternating current power source;

an electric lamp;

a first transformer having primary and secondary coils, said primary coil being connected to said alternating current source;

a second transformer having primary and secondary coils, said second transformer secondary coil being connected to said electric lamp; p1 a first safety capacitor having two plates and two terminals connected to each of said plates;

a second safety capacitor having two plates and two terminals connected to each of said plates;

a long power supply line connecting said secondary of said first transformer, said primary of said second transformer, one of said terminals on each plate of said first safety capacitor and one of said terminals on each plate of said second safety capacitor in series circuit;

a lamp operation detector having an output connected to the other terminal on each plate of said second capacitor, said detector including means for sensing the operational state of said lamp and means responsive to said sensing means for producing a direct current on said output indicative of an operational state sensed by said sensing means; and receiver means connected to the other terminal on each plate of said first capacitor for producing an output signal in response only to said direct current.

2. The device according to claim 1, wherein said sensing means comprises a photoelectric cell.

3. The device according to claim 2, wherein said photoelectric cell is constructed to be sensitive only to infrared radiation.

4. The device according to claim 1, wherein said sensing means comprises a thermocouple placed in the immediate vicinity of the filament of said lamp.

5. The device according to claim 1, wherein said sensing means comprises a current transformer having a primary coil placed in series circuit with the secondary coil of said second transformer and a secondary coil connected with inlet terminals of a rectifier, said rectifier having outlet terminals connected to said other terminal on each plate of said second capacitor through a filter permitting only the conduction of direct current.

6. A device according to claim 5, wherein said filter comprises an inductance connected between said rectifier and said second capacitor.

7. A device according to claim 5, wherein said filter comprises a third capacitor placed between the outlet terminals of said rectifier.

8. A system according to claim 7, wherein said third capacitor is a safety capacitor having two plates and two terminals connected to each of said plates, one terminal of each plate of said third capacitor being connected between the outlet terminals of said rectifier and the other terminal on each of said plates of said third capacitor being connected to the other terminal on each plate of said second capacitor.

9. A device according to claim 7, wherein said third capacitor is a high strength chemical capacitor capable of delaying the operation of said receiver means during a drop in voltage when said lamp operates in a flashing mode.

* * * * *